US011241740B2

(12) United States Patent
Zhang et al.

(10) Patent No.: US 11,241,740 B2
(45) Date of Patent: Feb. 8, 2022

(54) METHOD FOR PREPARING HIGH-MELTING-POINT METAL POWDER THROUGH MULTI-STAGE DEEP REDUCTION

(71) Applicant: NORTHEASTERN UNIVERSITY, Shenyang (CN)

(72) Inventors: Ting An Zhang, Shenyang (CN); Zhihe Dou, Shenyang (CN); Yan Liu, Shenyang (CN); Zimu Zhang, Shenyang (CN); Guozhi Lv, Shenyang (CN); Qiuyue Zhao, Shenyang (CN); Liping Niu, Shenyang (CN); Daxue Fu, Shenyang (CN); Weiguang Zhang, Shenyang (CN)

(73) Assignee: NORTHEASTERN UNIVERSITY, Shenyang (CN)

( * ) Notice: Subject to any disclaimer, the term of this patent is extended or adjusted under 35 U.S.C. 154(b) by 370 days.

(21) Appl. No.: 16/498,151

(22) PCT Filed: May 21, 2018

(86) PCT No.: PCT/CN2018/087587
§ 371 (c)(1),
(2) Date: Sep. 26, 2019

(87) PCT Pub. No.: WO2018/214830
PCT Pub. Date: Nov. 29, 2018

(65) Prior Publication Data

US 2020/0276648 A1 Sep. 3, 2020

(30) Foreign Application Priority Data

May 23, 2017 (CN) ..... 201710365992.1

(51) Int. Cl.
*B22F 9/24* (2006.01)
*C22B 34/00* (2006.01)

(52) U.S. Cl.
CPC ..... *B22F 9/24* (2013.01); *C22B 34/00* (2013.01); *B22F 2301/20* (2013.01)

(58) Field of Classification Search
CPC ..... B22F 9/24; B22F 2301/20; C22B 34/00
(Continued)

(56) References Cited

FOREIGN PATENT DOCUMENTS

CN 103466648 A 12/2013
CN 103466649 A 12/2013
(Continued)

OTHER PUBLICATIONS

RU-2649099-C2 Translation (Year: 2018).*

*Primary Examiner* — Brian D Walck
*Assistant Examiner* — Danielle Carda
(74) *Attorney, Agent, or Firm* — Muncy, Geissler, Olds & Lowe, P.C.

(57) ABSTRACT

The invention relates to a method for preparing high-melting-point metal powder through multi-stage deep reduction, and belongs to the technical field of preparation of powder. The method includes the following steps of mixing dried high-melting-point metal oxide powder with magnesium powder and performing a self-propagating reaction, placing an intermediate product into a closed reaction kettle, leaching the intermediate product with hydrochloric acid as a leaching solution so as to obtain a low-valence oxide $Me_xO$ precursor of the low-valence high-melting-point metal; uniformly mixing the precursor with calcium powder, pressing the mixture, placing the pressed mixture into a vacuum reduction furnace, heating the vacuum reduction furnace to 700-1200° C., performing deep reduction for 1-6 h, leaching a deep reduction product with hydrochloric acid as a leach-
(Continued)

ing solution and performing treatment, so as to obtain the high-melting-point metal powder.

10 Claims, 1 Drawing Sheet

(58) Field of Classification Search
USPC ..... 75/370
See application file for complete search history.

(56) References Cited

FOREIGN PATENT DOCUMENTS

| | | | |
|---|---|---|---|
| CN | 104131128 | A | 11/2014 |
| CN | 104131178 | A | 11/2014 |
| CN | 107236868 | A | 10/2017 |
| CN | 107236869 | A | 10/2017 |
| JP | 2002/180145 | A | 6/2002 |
| RU | 2649099 | C2 * | 3/2018 |
| WO | WO 95/025824 | A1 | 9/1995 |

* cited by examiner

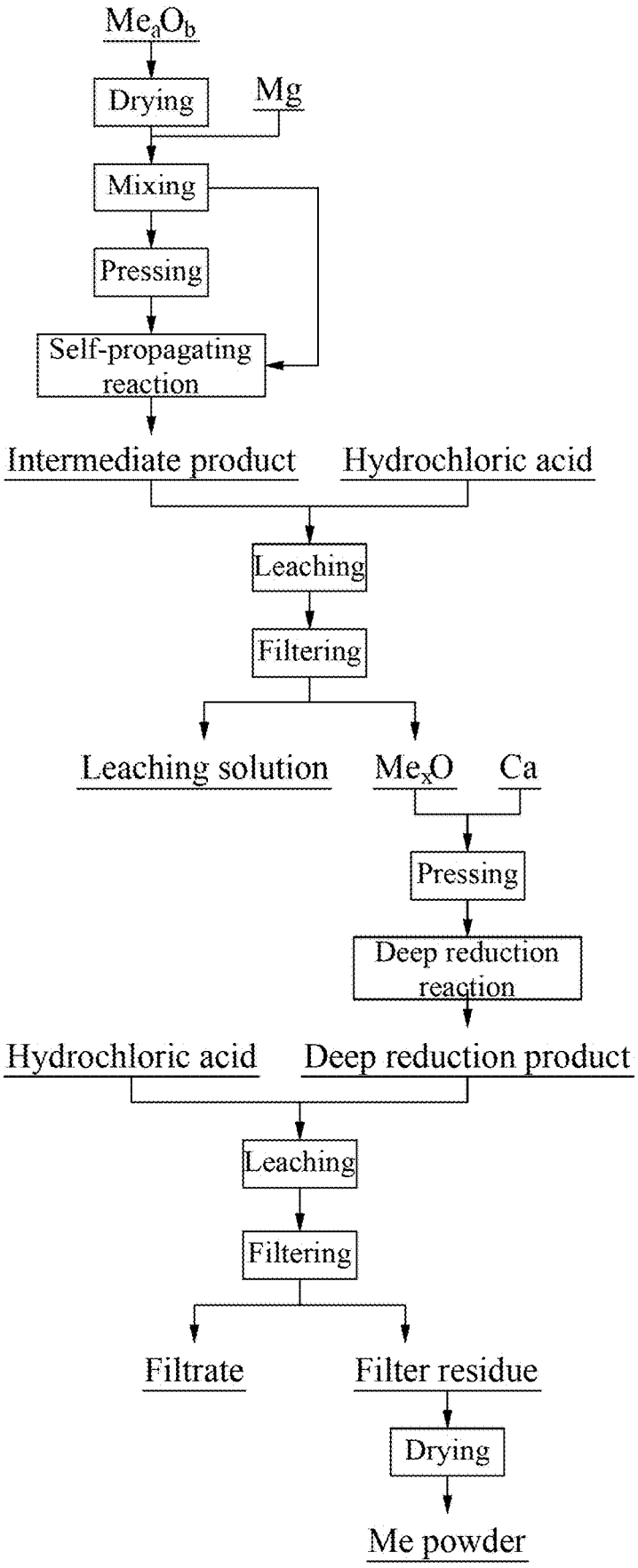
$Me_aO_b$
Drying
Mg
Mixing
Pressing
Self-propagating reaction
Intermediate product
Hydrochloric acid
Leaching
Filtering
Leaching solution
$Me_xO$
Ca
Pressing
Deep reduction reaction
Hydrochloric acid
Deep reduction product
Leaching
Filtering
Filtrate
Filter residue
Drying
Me powder

METHOD FOR PREPARING HIGH-MELTING-POINT METAL POWDER THROUGH MULTI-STAGE DEEP REDUCTION

BACKGROUND OF THE INVENTION

1. Field of the Invention

The invention belongs to the technical field of powder preparation in a powder metallurgy process, and particularly relates to a method for preparing a high-melting-point metal powder through a multi-stage deep reduction.

2. The Prior Arts

High-melting-point metal is also called 'refractory metal', usually refers to W, Mo, Nb, Ta, V and Zr and can also comprise Hf and Re. This type of metal has the characteristics of being high in melting point, high in strength and strong in corrosion resistance, and compounds being high in melting points, high in hardness and good in chemical stability can be generated by most of the metal together with C, N, Si, B and the like.

Zr is the high-melting-point metal with small thermal neutron capture cross section and outstanding nuclear properties and is an indispensable material for the development of the atomic energy industry. Ta is one of rare metal resources, has moderate hardness, high ductility, small coefficient of thermal expansion and extremely high corrosion resistance and is an indispensable strategic raw material for the development of the electronic industry and a space technology. W and Mo have high melting points and hard quality. Tungsten powder is a main raw material for processing powder metallurgy tungsten products and tungsten alloys. Molybdenum powder is widely used in the fields of paint, coating and polymer additives. Niobium powder is used as a sputtering target additive in the semiconductor field, and the demand for the niobium powder is increased day by day. Vanadium powder is used for cladding material of a fast neutron reactor and an additive for producing superconducting materials and special alloys. Hafnium powder can be used as a propeller for a rocket and can also be used for producing a cathode for an X-ray tube in the electrical industry. Hf is a most important additive for high-melting-point alloys, and the alloys can be used as an advanced protective layer for a rocket nozzle and a gliding re-entry vehicle. Re is the important high-melting-point metal, is used for producing a filament of an electric lamp, shells of an artificial satellite and a rocket, a protective plate of an atomic reactor and the like and is used as a catalyst in the chemistry.

At present, large-scale production of zirconium powder is still mainly based on a hydrogenation-dehydrogenation method; in the method, sponge zirconium, titanium or zirconium scraps are taken as raw materials, so that the cost of raw materials is relatively high, and preparation of high-grade zirconium powder is greatly influenced by the raw materials; the metal powder bodies produced by mechanical methods such as ball milling and crushing and atomization by using a vanadium block, a zirconium block and a hafnium block as raw materials have high production cost and uneven particle size, so that the large-scale application of the vanadium powder, the zirconium powder and the hafnium powder is limited. At present, industrial production of tantalum powder is mainly based on a sodium thermal method, and namely that in halides containing Mg, Ca, Sr and Ba, alkali metals Na and K are used for reducing tantalum oxide to prepare the tantalum powder. However, the production cost is high, and the product is high in temperature sensitivity, therefore, thermal stress produced after elevated temperature zone melting of a direct manufacturing technology of a metal member seriously affects the strength of the member. According to a conventional preparation process, the tungsten powder and the molybdenum powder are both prepared by a method for reducing oxides with hydrogen, and the requirements on equipment are high. The production of niobium powder is mainly based on a carbon or metal reduction method; and during the production, a niobium block needs to be hydrogenated and crushed firstly, and the method is complex in process and long in flow. Rhenium powder is currently prepared by using $KReO_4$ and $Re_2O_7$ as raw materials and KCl as an additive through reduction with hydrogen. The hydrogen is introduced, so that the process has high requirements on equipment and safety.

Aiming at the technical problems existing in the existing preparation methods of powder of high-melting-point metal such as W, Mo, Ta, Nb, Zr, V, Hf, Re and the like, according to the method disclosed by the invention, a valence state evolution rule in reduction processes of oxides of the high-melting-point metal such as W, Mo, Ta, Nb, Zr, V, Hf and Re is systematically analyzed, and a new idea of directly preparing powder of the high-melting-point metal such as W, Mo, Ta, Nb, Zr, V, Hf and Re through multistage deep thermal reduction is proposed. Namely, first, self-propagating fast reaction is performed for primary reduction to obtain an intermediate product (a combustion product), then, the intermediate product is subjected to multi-stage deep reduction to obtain a deep reduction product, and finally, the deep reduction product is subjected to acid leaching, impurity removal and purification to obtain the powder of the high-melting-point metal such as W, Mo, Ta, Nb, Zr, V, Hf and Re.

Besides, the powder of the high-melting-point metal such as W, Mo, Ta, Nb, Zr, V, Hf and Re is prepared by a multi-stage deep reduction method, metal oxides are taken as raw materials, the raw materials are easy to obtain, and the cost is low. Besides, the multi-stage deep reduction method has the advantages of being short in the process flow without an intermediate working procedure, low in cost and good in product properties, so that continuous production is easier to achieve. The multi-stage metal thermal reduction method for preparing the powder of the high-melting-point metal such as W, Mo, Ta, Nb, Zr, V, Hf and Re is one of most potential refractory metal powder preparation technologies and conforms to national economic development strategies of reducing the cost of the raw materials and saving energy; and the technology has very considerable industrial economic and social benefits.

SUMMARY OF THE INVENTION

Aiming at the defects of preparing refractory metal powder in the prior art, the invention provides a method for preparing high-melting-point metal powder through multi-stage deep reduction, and a low-oxygen high-melting-point metal powder product is obtained through SHS (self-propagating high-temperature synthesis), deep reduction and dilute acid leaching. The method is a method for preparing powder of the high-melting-point metal with high purity, slight fineness and low oxygen. The method gets the advantages of being low in cost of raw materials, simple to operate and low in requirements on process conditions as well as instruments and equipment and laying a foundation for industrial production. The obtained low-oxygen high-melting-point metal powder has the advantages of being high in purity, controllable in particle size distribution, high in powder activity and the like.

The method for preparing high-melting-point metal powder through multi-stage deep reduction provided by the invention comprises the following steps:

Step 1, Performing Self-Propagating Reaction:

Drying high-melting-point metal oxide powder to obtain dried high-melting-point metal oxide powder, mixing the dried high-melting-point metal oxide powder with magnesium powder to obtain mixed materials, adding the mixed materials into a self-propagating reaction furnace to perform a self-propagating reaction, and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, x is 0.2-1, The high-melting-point metal Me specifically comprises one or more of W, Mo, Ta, Nb, V, Zr, Hf and Re, The high-melting-point metal oxide is one or a mixture of several kinds of $WO_3$, $MoO_3$, $Ta_2O_5$, $Nb_2O_5$, $V_2O_5$, $ZrO_2$, $HfO_2$ and $Re_2O_7$, When the high-melting-point metal oxide is $WO_3$, the mixing proportion in molar ratio of $WO_3$ to Mg is 1 to (0.8-1.2), when the high-melting-point metal oxide is $MoO_3$, the mixing proportion in molar ratio of $MoO_3$ to Mg is 1 to (0.8-1.2), when the high-melting-point metal oxide is $Ta_2O_5$, the mixing proportion in molar ratio of $Ta_2O_5$ to Mg is 1 to (2.7-3.3), when the high-melting-point metal oxide is $Nb_2O_5$, the mixing proportion in molar ratio of $Nb_2O_5$ to Mg is 1 to (2.7-3.3), when the high-melting-point metal oxide is $V_2O_5$, the mixing proportion in molar ratio of $V_2O_5$ to Mg is 1 to (2.7-3.3), when the high-melting-point metal oxide is $ZrO_2$, the mixing proportion in molar ratio of $ZrO_2$ to Mg is 1 to (0.8-1.2), when the high-melting-point metal oxide is $HfO_2$, the mixing proportion in molar ratio of $HfO_2$ to Mg is 1 to (0.8-1.2), and when the high-melting-point metal oxide is $Re_2O_7$, the mixing proportion in molar ratio of $Re_2O_7$ to Mg is 1 to (2.7-3.3);

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution to obtain a leaching solution and a leaching product, removing the leaching solution, washing the leaching product, and performing vacuum drying on the washed leaching product to obtain a low-valence oxide $Me_xO$ precursor of the low-valence high-melting-point metal, wherein the molar concentration of hydrochloric acid is 1-6 mol/L;

Step 3, Performing Multi-Stage Deep Reduction:

Uniformly mixing the low-valence oxide $Me_xO$ precursor of the low-valence high-melting-point metal with calcium powder, performing pressing at 2-20 MPa to obtain a block blank, placing the block blank in a vacuum reduction furnace, performing heating to 700-1,200° C., performing secondary deep reduction for 1-6 h, obtaining a block billet after secondary deep reduction, and cooling the block billet along with the furnace to obtain a deep reduction product, wherein the molar ratio is described as follows: $Me_xO$:Ca=1:(1.5-3); and Step 4, Performing Secondary Leaching:

Placing the deep reduction product in the closed reaction kettle, leaching the deep reduction product with hydrochloric acid as a leaching solution to obtain filtrate and filter residues, removing the filtrate, washing the filter residues and performing vacuum drying to obtain the low-oxygen high-melting-point metal powder, wherein the molar concentration of hydrochloric acid is 1-6 mol/L, The low-oxygen high-melting-point metal powder comprises the following ingredients by percentage by mass of equal to or smaller than 0.8% of O, greater than or equal to 99% of the high-melting-point metal Me and the balance of inevitable impurities, and the particle size of the low-oxygen high-melting-point metal powder is 5-60 μm.

In the step 1, the drying process specifically comprises the following operating steps: placing the high-melting-point metal oxide powder into a drying oven, and performing drying at the temperature of 100-150° C. for 24 h or above.

In the step 1, the mixing proportion of the materials is calculated separately with Mg according to the types of added high-melting-point metal oxides and the above ratio when the materials are mixed.

In the step 1, the mixed materials are treated in one of the following two ways before being added into the self-propagating reaction furnace:

The first treatment way comprises the following steps: pressing the mixed materials under 10-60 MPa to obtain the block blank, adding the block blank into the self-propagating reaction furnace and performing the self-propagating reaction; and The second treatment way comprises the following steps: directly adding the mixed materials into the self-propagating reaction furnace without treatment and performing the self-propagating reaction.

In the step 1, the intermediate product mainly adopt refractory metal monoxide obtained by a primary reduction reaction process in a self-propagating form, so that energy consumption is saved; and besides, generation of composite metal oxide impurities can be inhibited in the reduction reaction process.

In the step 1, initiation modes of the self-propagating reaction are respectively a local ignition method and an overall heating method, wherein the local ignition method refers to heating the local part of the mixed materials by an electric heating wire in the self-propagating reaction furnace to initiate the self-propagating reaction; the overall heating method refers to raising the temperature of the whole mixed materials in the self-propagating reaction furnace until the self-propagating reaction occurs, and the temperature is controlled at 500-750° C.

In the step 2, when the intermediate product is leached, diluted hydrochloric acid and the intermediate product are in cooperation in a manner that the adding amount of diluted hydrochloric acid is 10-40% in excess of hydrochloric acid required by a reaction theory, and the chemical equation, on which the reaction is based, is described as follows: $MgO+2H^+=Mg^{2+}+H_2O$.

In the step 2, the leaching temperature for leaching the intermediate product is 20-30° C., and the leaching time is 60-180 min.

In the step 2, the low-valence oxide $Me_xO$ precursor of the low-valence high-melting-point metal comprises the following ingredients by percentage by mass of 5-20% of O, smaller than or equal to 0.5% of the inevitable impurities and the balance of the high-melting-point metal, wherein the particle size is 0.8-15 μm.

In the step 2, the washing process and the vacuum drying process comprises the following specific steps: washing the leaching product without the leaching solution with water until a washing solution is neutral, and then drying the washed leaching product in the vacuum drying oven at the temperature of 20-30° C. for at least 24 h;

The washing is performed with water and specifically refers to dynamic washing, i.e. the washing solution in a washing tank is kept at a constant water level in the washing process, fresh water with the same amount of the drained washing liquid is supplemented, and the leaching product is washed until the washing liquid is neutral.

In the step 3, the reaction parameter for the secondary deep reduction lies in that heating is performed under the condition that the vacuum degree is less than or equal to 10 Pa.

In the step 4, when the deep reduction product is leached out, diluted hydrochloric acid and the deep reduction product are in cooperation in a manner that the adding amount of diluted hydrochloric acid is 5-30% in excess of hydrochloric acid required by a reaction theory, and the chemical equation, on which the reaction is based, is $CaO+2H^{+}=Ca^{2+}+H_2O$.

In the step 4, the leaching temperature for leaching the deep reduction product is 20-30° C., and the leaching time is 15-90 min.

In the step 4, the washing process and the vacuum drying process comprise the following specific steps: washing the leaching product without the leaching solution with water until a washing solution is neutral, and then drying the washed leaching product in the vacuum drying oven at the temperature of 20-30° C. for at least 24 h; and The washing is performed with water and specifically refers to dynamic washing, i.e. the washing solution in a washing tank is kept at a constant water level in the washing process, fresh water with the same amount of the drained washing liquid is supplemented, and the leaching product is washed until the washing liquid is neutral.

The method for preparing high-melting-point metal powder through multi-stage deep reduction provided by the invention has the principle and advantages that:

The SHS process is used as a primary reduction reaction by utilizing a valence state evolution rule of the oxides of the high-melting-point metal in the reduction processes, and the chemical energy of the chemical reaction is fully utilized. The chemical energy is converted into heat energy by the SHS process, the reaction can realize self-propagating once being initiated, and the reaction can be self-sustained without additional energy; and besides, the temperature gradient of the reaction is high, the activity of the product is high, and the particle size of the product is controllable. As the temperature of the self-propagating reaction is high, Mg is gasified during the reaction, causing the loss of Mg. The composition and the phase of the $Me_xO$ product can be controlled by adjusting the dosage of magnesium.

The equation for an SHS reaction is described as follows:

$$Me_aO_b+yMg=(a/x)Me_xO+(b-a/x)MgO+(y+a/x-b)Mg$$

Wherein Me is the high-melting-point metal, a and b take different values according to the difference of the high melting point metal Me, x and y are parameters in stoichiometric numbers in a balancing process of the chemical reaction, x is 0.2-1, and y is adjusted according to the value of x.

MgO impurities generated in the self-propagating reaction process are loose, the product is easy to break, the reaction activity of the MgO impurities is high, the intermediate product $Me_xO$ exists in the form of particles or particle skeletons, and the MgO impurities are wrapped on the surface of the $Me_xO$ or stuffed in a $Me_xO$ skeleton, so that the leaching of diluted hydrochloric acid is facilitated.

(2) In order to ensure complete removal of MgO in the leaching process, hydrochloric acid needs to be added in excess; besides, in order to ensure the washing effect, dynamic circulation washing is adopted in the washing process, i.e. the washing solution in the washing tank is kept at a constant water level in the washing process, and the fresh water with the same amount of the drained washing liquid is supplemented, and the leaching product is washed until the washing liquid is neutral. In order to ensure the leaching efficiency and prevent the oxidation of the intermediate product, the leaching process needs to be performed in the closed kettle.

(3) In order to ensure thorough deoxidization and obtain low-oxygen high-purity reduced titanium powder, a concept of multi-stage deep reduction deoxidization is proposed, i.e. calcium, which has stronger reducibility than a magnesium reductant used in self-propagating high-temperature reduction, is used for performing deep reduction deoxidization on the low-valence metal oxide precursor obtained by self-propagating high-temperature reduction, so that the reduction deoxidization effect is ensured.

The chemical reaction equation of the deep reduction reaction is described as follows: $Me_xO+xCa=Me+xCaO$, wherein x is 0.2-1.

(4) The process is effective, energy-saving, short in process and low in requirements on equipment, is a clean, efficient and safe production process and is easy for industrial popularization. The method can also be used for preparing other high-melting-point variable valence metal powder.

BRIEF DESCRIPTION OF THE DRAWINGS

FIGURE is a process flow chart of a method for preparing high-melting-point metal powder through multi-stage deep reduction.

DETAILED DESCRIPTION OF THE PREFERRED EMBODIMENT

The invention is further described in details through combination with an embodiment.

High-melting-point metal oxide powder, magnesium powder, calcium powder and hydrochloric acid used in the following embodiment are all industrial grade products. Particle sizes of the high-melting-point metal oxide powder, the magnesium powder and the calcium powder are smaller than equal to 0.5 mm.

A self-propagating reaction furnace used in the following embodiment is a self-propagating reaction furnace disclosed in the patent "ZL200510047308.2." The reaction furnace consists of a reaction container, a heater, a sight glass, a transformer, a function recorder, a thermocouple and a vent valve.

The time of a self-propagating reaction in the following embodiment is 5-90 s.

The drying time in the following embodiment is at least 24 h.

In the following embodiment, a process flow chart of the method for preparing high-melting-point metal powder through multi-stage deep reduction is shown in FIGURE.

Embodiment 1

The method for preparing high-melting-point metal powder through multi-stage deep reduction provided by the invention comprises the following steps:

Step 1, Performing Self-Propagating Reaction:

Placing tungsten oxide powder in a drying oven, drying the tungsten oxide powder at the temperature of 100-150° C. for 24 h to obtain dried tungsten oxide powder, mixing the dried tungsten oxide powder with the magnesium powder according to a molar ratio of $WO_3$ to Mg being 1 to 1 to obtain mixed materials, pressing the mixed materials at 20 MPa to obtain a block blank, adding the block blank into the self-propagating reaction furnace, initiating the self-propagating reaction in a local ignition mode, controlling the temperature at 500° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 25° C. and the leaching time is 120 min to obtain a leaching solution and a leaching product, removing the leaching solution, washing the leaching product in a dynamic washing mode, and performing vacuum drying at 20° C. for 24 h to obtain an oxide $W_xO$ precursor of the low-valence high-melting-point metal, wherein the molar concentration of hydrochloric acid is 2 mol/L, the diluted hydrochloric acid and the intermediate product are in cooperation in a manner that the adding amount of diluted hydrochloric acid is 10-40% in excess of hydrochloric acid required by a reaction theory, and The oxide $W_xO$ precursor of the low-valence high-melting-point metal comprises the following ingredients by percentage by mass of 12% of O, smaller than or equal to 0.5% of the inevitable impurities and the balance of the high-melting-point metal, wherein the particle size is 0.8-15 μm;

Step 3, Performing Multi-Stage Deep Reduction:

Uniformly mixing the oxide $W_xO$ precursor of the low-valence high-melting-point metal with calcium powder, performing pressing at 5 MPa to obtain a block blank, placing the block blank in a vacuum reduction furnace, performing heating under the condition that the vacuum degree is smaller than or equal to 10 Pa to 1000° C., performing secondary deep reduction for 2 h, obtaining a block billet after secondary deep reduction, and cooling the block billet along with the furnace to obtain a deep reduction product, wherein the molar ratio is described as follows: $W_xO$:Ca=1:2; and Step 4, Performing Secondary Leaching:

Placing the deep reduction product in the closed reaction kettle, leaching the deep reduction product with hydrochloric acid as a leaching solution at the temperature of 25° C. for 30 min to obtain filtrate and filter residues, removing the filtrate, washing the filter residues in a dynamic washing mode and drying the washed filter residues at the temperature of 30° C. for 24 h under a vacuum condition to obtain low-oxygen tungsten powder, wherein the molar concentration of hydrochloric acid is 1 mol/L, and diluted hydrochloric acid and the deep reduction product are in cooperation in a manner that the adding amount of diluted hydrochloric acid is 5-30% in excess of hydrochloric acid required by a reaction theory; and The low-oxygen tungsten powder comprises the following ingredients in percentage by mass: 99.3% of W, 0.34% of O and the balance of inevitable impurities, and the particle size of the low-oxygen tungsten powder is 38 μm.

Embodiment 2

The method for preparing high-melting-point metal powder through multi-stage deep reduction provided by the invention comprises the following steps:

Step 1, Performing Self-Propagating Reaction:

Placing tungsten oxide powder in a drying oven, drying the tungsten oxide powder at the temperature of 100-150° C. for 24 h to obtain dried tungsten oxide powder, mixing the dried tungsten oxide powder with the magnesium powder according to a molar ratio of $WO_3$ to Mg being 1 to 1.2 to obtain mixed materials, pressing the mixed materials at 10 MPa to obtain a block blank, adding the block blank into the self-propagating reaction furnace, initiating the self-propagating reaction in a local ignition mode, controlling the temperature at 750° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 25° C. and the leaching time is 120 min to obtain a leaching solution and a leaching product, removing the leaching solution, washing the leaching product in a dynamic washing mode, and performing vacuum drying at 20° C. for 24 h to obtain an oxide $W_xO$ precursor of the low-valence high-melting-point metal, wherein the molar concentration of hydrochloric acid is 1 mol/L, the diluted hydrochloric acid and the intermediate product are in cooperation in a manner that the adding amount of diluted hydrochloric acid is 10% in excess of hydrochloric acid required by a reaction theory, and The oxide $W_xO$ precursor of the low-valence high-melting-point metal comprises the following ingredients by percentage by mass of 20% of O, smaller than or equal to 0.5% of the inevitable impurities and the balance of the high-melting-point metal, wherein the particle size is 0.8-15 μm;

Step 3, Performing Multi-Stage Deep Reduction:

Uniformly mixing the oxide $W_xO$ precursor of the low-valence high-melting-point metal with calcium powder, performing pressing at 10 MPa to obtain a block blank, placing the block blank in a vacuum reduction furnace, performing heating under the condition that the vacuum degree is smaller than or equal to 10 Pa to 900° C., performing secondary deep reduction for 3 h, obtaining a block billet after secondary deep reduction, and cooling the block billet along with the furnace to obtain a deep reduction product, wherein the molar ratio is described as follows: $W_xO$:Ca=1:2.2; and Step 4, Performing Secondary Leaching:

Placing the deep reduction product in the closed reaction kettle, leaching the deep reduction product with hydrochloric acid as a leaching solution at the temperature of 25° C. for 15 min to obtain filtrate and filter residues, removing the filtrate, washing the filter residues in a dynamic washing mode and drying the washed filter residues at the temperature of 30° C. for 24 h under a vacuum condition to obtain low-oxygen tungsten powder, wherein the molar concentration of hydrochloric acid is 2 mol/L, and diluted hydrochloric acid and the deep reduction product are in cooperation in a manner that the adding amount of diluted hydrochloric acid is 10% in excess of hydrochloric acid required by a reaction theory; and The low-oxygen tungsten powder comprises the following ingredients in percentage by mass: 99.5% of W, 0.13% of O and the balance of inevitable impurities, and the particle size of the low-oxygen tungsten powder is 28 μm.

Embodiment 3

The method for preparing high-melting-point metal powder through multi-stage deep reduction provided by the invention comprises the following steps:

Step 1, Performing Self-Propagating Reaction:

Placing tungsten oxide powder in a drying oven, drying the tungsten oxide powder at the temperature of 100-150° C. for 24 h to obtain dried tungsten oxide powder, mixing the dried tungsten oxide powder with the magnesium powder according to a molar ratio of $WO_3$ to Mg being 1 to 0.8 to obtain mixed materials, pressing the mixed materials at 60 MPa to obtain a block blank, adding the block blank into the self-propagating reaction furnace, initiating the self-propagating reaction in a local ignition mode, controlling the temperature at 650° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 25° C. and the leaching time is 60 min to obtain a leaching solution and a leaching product, removing the leaching solution, washing the leaching product in a dynamic washing mode, and performing vacuum drying at 30° C. for 24 h to obtain an oxide $W_xO$ precursor of the low-valence high-melting-point metal, wherein the molar concentration of hydrochloric acid is 6 mol/L, the diluted hydrochloric acid and the intermediate product are in cooperation in a manner that the adding amount of diluted hydrochloric acid is 10% in excess of hydrochloric acid required by a reaction theory, and The oxide $W_xO$ precursor of the low-valence high-melting-point metal comprises the following ingredients by percentage by mass of 5% of O, smaller than or equal to 0.5% of the inevitable impurities and the balance of the high-melting-point metal, wherein the particle size is 0.8-15 μm;

Step 3, Performing Multi-Stage Deep Reduction:

Uniformly mixing the oxide $W_xO$ precursor of the low-valence high-melting-point metal with calcium powder, performing pressing at 15 MPa to obtain a block blank, placing the block blank in a vacuum reduction furnace, performing heating under the condition that the vacuum degree is smaller than or equal to 10 Pa to 1100° C., performing secondary deep reduction for 2 h, obtaining a block billet after secondary deep reduction, and cooling the block billet along with the furnace to obtain a deep reduction product, wherein the molar ratio is described as follows: $W_xO$:Ca=1:3; and Step 4, Performing Secondary Leaching:

Placing the deep reduction product in the closed reaction kettle, leaching the deep reduction product with hydrochloric acid as a leaching solution at the temperature of 20° C. for 30 min to obtain filtrate and filter residues, removing the filtrate, washing the filter residues in a dynamic washing mode and drying the washed filter residues at the temperature of 25° C. for 24 h under a vacuum condition to obtain low-oxygen tungsten powder, wherein the molar concentration of hydrochloric acid is 1 mol/L, and diluted hydrochloric acid and the deep reduction product are in cooperation in a manner that the adding amount of diluted hydrochloric acid is 30% in excess of hydrochloric acid required by a reaction theory; and The low-oxygen tungsten powder comprises the following ingredients in percentage by mass: 99.6% of W, 0.09% of O and the balance of inevitable impurities, and the particle size of the low-oxygen tungsten powder is 41 μm.

Embodiment 4

The method for preparing high-melting-point metal powder through multi-stage deep reduction provided by the invention comprises the following steps:

Step 1, Performing Self-Propagating Reaction:

Placing molybdenum oxide powder in a drying oven, drying the molybdenum oxide powder at the temperature of 100-150° C. for 24 h to obtain dried molybdenum oxide powder, mixing the dried molybdenum oxide powder with the magnesium powder according to a molar ratio of $MoO_3$ to Mg being 1 to 1.1 to obtain mixed materials, pressing the mixed materials at 20 MPa to obtain a block blank, adding the block blank into the self-propagating reaction furnace, initiating the self-propagating reaction in a local ignition mode, controlling the temperature at 550° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 25° C. and the leaching time is 90 min to obtain a leaching solution and a leaching product, removing the leaching solution, washing the leaching product in a dynamic washing mode, and performing vacuum drying at 30° C. for 24 h to obtain an oxide $Mo_xO$ precursor of the low-valence high-melting-point metal, wherein the molar concentration of hydrochloric acid is 4 mol/L, the diluted hydrochloric acid and the intermediate product are in cooperation in a manner that the adding amount of diluted hydrochloric acid is 10% in excess of hydrochloric acid required by a reaction theory, and The oxide $Mo_xO$ precursor of the low-valence high-melting-point metal comprises the following ingredients by percentage by mass of 10% of O, smaller than or equal to 0.5% of the inevitable impurities and the balance of the high-melting-point metal, wherein the particle size is 0.8-15 μm;

Step 3, Performing Multi-Stage Deep Reduction:

Uniformly mixing the oxide $Mo_xO$ precursor of the low-valence high-melting-point metal with calcium powder, performing pressing at 5 MPa to obtain a block blank, placing the block blank in a vacuum reduction furnace, performing heating under the condition that the vacuum degree is smaller than or equal to 10 Pa to 900° C., performing secondary deep reduction for 3 h, obtaining a block billet after secondary deep reduction, and cooling the block billet along with the furnace to obtain a deep reduction product, wherein the molar ratio is described as follows: $Mo_xO$:Ca=1:2.4; and Step 4, Performing Secondary Leaching:

Placing the deep reduction product in the closed reaction kettle, leaching the deep reduction product with hydrochloric acid as a leaching solution at the temperature of 30° C. for 20 min to obtain filtrate and filter residues, removing the filtrate, washing the filter residues in a dynamic washing mode and drying the washed filter residues at the temperature of 25° C. for 24 h under a vacuum condition to obtain low-oxygen molybdenum powder, wherein the molar concentration of hydrochloric acid is 2 mol/L, and diluted hydrochloric acid and the deep reduction product are in cooperation in a manner that the adding amount of diluted hydrochloric acid is 5-30% in excess of hydrochloric acid required by a reaction theory; and the low-oxygen molybdenum powder comprises the following ingredients in percentage by mass: 99.0% of Mo, 0.31% of O and the balance of inevitable impurities, and the particle size of the low-oxygen tungsten powder is 28 μm.

Embodiment 5

The method for preparing high-melting-point metal powder through multi-stage deep reduction provided by the invention comprises the following steps:

Step 1, Performing Self-Propagating Reaction:

Placing molybdenum oxide powder in a drying oven, drying the molybdenum oxide powder at the temperature of 100-150° C. for 24 h to obtain dried molybdenum oxide powder, mixing the dried molybdenum oxide powder with the magnesium powder according to a molar ratio of $MoO_3$ to Mg being 1 to 0.8 to obtain mixed materials, pressing the mixed materials at 40 MPa to obtain a block blank, adding the block blank into the self-propagating reaction furnace, initiating the self-propagating reaction in a local ignition mode, controlling the temperature at 700° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 25° C. and the leaching time is 100 min to obtain a leaching solution and a leaching product, removing the leaching solution, washing the leaching product in a dynamic washing mode, and performing vacuum drying at 20° C. for 24 h to obtain an oxide $Mo_xO$ precursor of the low-valence high-melting-point metal, wherein the molar concentration of hydrochloric acid is 2 mol/L, the diluted hydrochloric acid and the intermediate product are in cooperation in a manner that the adding amount of diluted hydrochloric acid is 10% in excess of hydrochloric acid required by a reaction theory, and The oxide $Mo_xO$ precursor of the low-valence high-melting-point metal comprises the following ingredients by percentage by mass of 10% of O, smaller than or equal to 0.5% of the inevitable impurities and the balance of the high-melting-point metal, wherein the particle size is 0.8-15 μm;

Step 3, Performing Multi-Stage Deep Reduction:

Uniformly mixing the oxide $Mo_xO$ precursor of the low-valence high-melting-point metal with calcium powder, performing pressing at 15 MPa to obtain a block blank, placing the block blank in a vacuum reduction furnace, performing heating under the condition that the vacuum degree is smaller than or equal to 10 Pa to 1000° C., performing secondary deep reduction for 2 h, obtaining a block billet after secondary deep reduction, and cooling the block billet along with the furnace to obtain a deep reduction product, wherein the molar ratio is described as follows: $Mo_xO$:Ca=1:2; and Step 4, Performing Secondary Leaching:

Placing the deep reduction product in the closed reaction kettle, leaching the deep reduction product with hydrochloric acid as a leaching solution at the temperature of 20-30° C. for 30 min to obtain filtrate and filter residues, removing the filtrate, washing the leaching product in a dynamic washing mode and drying the washed filter residues at the temperature of 25° C. for 24 h under a vacuum condition to obtain low-oxygen molybdenum powder, wherein the molar concentration of hydrochloric acid is 1 mol/L, and diluted hydrochloric acid and the deep reduction product are in cooperation in a manner that the adding amount of diluted hydrochloric acid is 5-30% in excess of hydrochloric acid required by a reaction theory; and the low-oxygen molybdenum powder comprises the following ingredients in percentage by mass: 99.2% of Mo, 0.34% of O and the balance of inevitable impurities, and the particle size of the low-oxygen tungsten powder is 33 μm.

Embodiment 6

The method for preparing high-melting-point metal powder through multi-stage deep reduction provided by the invention comprises the following steps:

Step 1, Performing Self-Propagating Reaction:

Placing molybdenum oxide powder in a drying oven, drying the molybdenum oxide powder at the temperature of 100-150° C. for 24 h to obtain dried molybdenum oxide powder, mixing the dried molybdenum oxide powder with the magnesium powder according to a molar ratio of $MoO_3$ to Mg being 1 to 1 to obtain mixed materials, pressing the mixed materials at 30 MPa to obtain a block blank, adding the block blank into the self-propagating reaction furnace, initiating the self-propagating reaction in a local ignition mode, controlling the temperature at 520° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 30° C. and the leaching time is 120 min to obtain a leaching solution and a leaching product, removing the leaching solution, washing the leaching product in a dynamic washing mode, and performing vacuum drying at 20° C. for 24 h to obtain an oxide $Mo_xO$ precursor of the low-valence high-melting-point metal, wherein the molar concentration of hydrochloric acid is 1 mol/L, the diluted hydrochloric acid and the intermediate product are in cooperation in a manner that the adding amount of diluted hydrochloric acid is 35% in excess of hydrochloric acid required by a reaction theory, and The oxide $Mo_xO$ precursor of the low-valence high-melting-point metal comprises the following ingredients by percentage by mass of 12% of O, smaller than or equal to 0.5% of the inevitable impurities and the balance of the high-melting-point metal, wherein the particle size is 0.8-15 μm;

Step 3, Performing Multi-Stage Deep Reduction:

Uniformly mixing the oxide $Mo_xO$ precursor of the low-valence high-melting-point metal with calcium powder, performing pressing at 5 MPa to obtain a block blank, placing the block blank in a vacuum reduction furnace, performing heating under the condition that the vacuum degree is smaller than or equal to 10 Pa to 1100° C., performing secondary deep reduction for 2 h, obtaining a block billet after secondary deep reduction, and cooling the block billet along with the furnace to obtain a deep reduction product, wherein the molar ratio is described as follows: $Mo_xO$:Ca=1:3; and Step 4, Performing Secondary Leaching:

Placing the deep reduction product in the closed reaction kettle, leaching the deep reduction product with hydrochloric acid as a leaching solution at the temperature of 20-30° C. for 15 min to obtain filtrate and filter residues, removing the filtrate, washing the filter residues in a dynamic washing mode and drying the washed filter residues at the temperature of 25 DEG C. for 24 h under a vacuum condition to obtain low-oxygen molybdenum powder, wherein the molar concentration of hydrochloric acid is 3 mol/L, and diluted hydrochloric acid and the deep reduction product are in cooperation in a manner that the adding amount of diluted hydrochloric acid is 5-30% in excess of hydrochloric acid required by a reaction theory; and The low-oxygen molybdenum powder comprises the following ingredients in percentage by mass: 99.4% of Mo, 0.37% of O and the balance of inevitable impurities, and the particle size of the low-oxygen tungsten powder is 44 μm.

Embodiment 7

The method for preparing high-melting-point metal powder through multi-stage deep reduction provided by the invention comprises the following steps:

Step 1, Performing Self-Propagating Reaction:

Placing tantalum oxide powder in a drying oven, drying the tantalum oxide powder at the temperature of 100-150° C. for 24 h to obtain dried tantalum oxide powder, mixing the dried tantalum oxide powder with the magnesium powder according to a molar ratio of $Ta_2O_5$ to Mg being 1 to 3 to obtain mixed materials, pressing the mixed materials at 20 MPa to obtain a block blank, adding the block blank into the self-propagating reaction furnace, initiating the self-propagating reaction in a local ignition mode, controlling the temperature at 720° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 20° C. and the leaching time is 60 min to obtain a leaching solution and a leaching product, removing the leaching solution, washing the leaching product in a dynamic washing mode, and performing vacuum drying at 20° C. for 24 h to obtain an oxide $Ta_xO$ precursor of the low-valence high-melting-point metal, wherein the molar concentration of hydrochloric acid is 6 mol/L, the diluted hydrochloric acid and the intermediate product are in cooperation in a manner that the adding amount of diluted hydrochloric acid is 15% in excess of hydrochloric acid required by a reaction theory, and The oxide $Ta_xO$ precursor of the low-valence high-melting-point metal comprises the following ingredients by percentage by mass of 10% of O, smaller than or equal to 0.5% of the inevitable impurities and the balance of the high-melting-point metal, wherein the particle size is 0.8-15 μm;

Step 3, Performing Multi-Stage Deep Reduction:

Uniformly mixing the oxide $Ta_xO$ precursor of the low-valence high-melting-point metal with calcium powder, performing pressing at 20 MPa to obtain a block blank, placing the block blank in a vacuum reduction furnace, performing heating under the condition that the vacuum degree is smaller than or equal to 10 Pa to 800° C., performing secondary deep reduction for 3 h, obtaining a block billet after secondary deep reduction, and cooling the block billet along with the furnace to obtain a deep reduction product, wherein the molar ratio is described as follows: $Ta_xO$:Ca=1:1.5; and Step 4, Performing Secondary Leaching:

Placing the deep reduction product in the closed reaction kettle, leaching the deep reduction product with hydrochloric acid as a leaching solution at the temperature of 30° C. for 15 min to obtain filtrate and filter residues, removing the filtrate, washing the filter residues in a dynamic washing mode and drying the washed filter residues at the temperature of 25° C. for 24 h under a vacuum condition to obtain low-oxygen tantalum powder, wherein the molar concentration of hydrochloric acid is 3 mol/L, and diluted hydrochloric acid and the deep reduction product are in cooperation in a manner that the adding amount of diluted hydrochloric acid is 25% in excess of hydrochloric acid required by a reaction theory; and The low-oxygen tantalum powder comprises the following ingredients in percentage by mass: 99.1% of Ta, 0.45% of O and the balance of inevitable impurities, and the particle size of the low-oxygen tungsten powder is 22 μm.

Embodiment 8

The method for preparing high-melting-point metal powder through multi-stage deep reduction provided by the invention comprises the following steps:

Step 1, Performing Self-Propagating Reaction:

Placing tantalum oxide powder in a drying oven, drying the tantalum oxide powder at the temperature of 100-150° C. for 24 h to obtain dried tantalum oxide powder, mixing the dried tantalum oxide powder with the magnesium powder according to a molar ratio of $Ta_2O_5$ to Mg being 1 to 3.2 to obtain mixed materials, pressing the mixed materials at 40 MPa to obtain a block blank, adding the block blank into the self-propagating reaction furnace, initiating the self-propagating reaction in a local ignition mode, controlling the temperature at 600° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 24° C. and the leaching time is 90 min to obtain a leaching solution and a leaching product, removing the leaching solution, washing the leaching product in a dynamic washing mode, and performing vacuum drying at 20° C. for 24 h to obtain an oxide $Ta_xO$ precursor of the low-valence high-melting-point metal, wherein the molar concentration of hydrochloric acid is 3 mol/L, the diluted hydrochloric acid and the intermediate product are in cooperation in a manner that the adding amount of diluted hydrochloric acid is 15% in excess of hydrochloric acid required by a reaction theory, and the oxide $Ta_xO$ precursor of the low-valence high-melting-point metal comprises the following ingredients by percentage by mass of 10% of O, smaller than or equal to 0.5% of the inevitable impurities and the balance of the high-melting-point metal, wherein the particle size is 0.8-15-μm;

Step 3, Performing Multi-Stage Deep Reduction:

Uniformly mixing the oxide $Ta_xO$ precursor of the low-valence high-melting-point metal with calcium powder, performing pressing at 10 MPa to obtain a block blank, placing the block blank in a vacuum reduction furnace, performing heating under the condition that the vacuum degree is smaller than or equal to 10 Pa to 900° C., performing secondary deep reduction for 3 h, obtaining a block billet after secondary deep reduction, and cooling the block billet along with the furnace to obtain a deep reduction product, wherein the molar ratio is described as follows: $Ta_xO$:Ca=1:2; and Step 4, Performing Secondary Leaching:

Placing the deep reduction product in the closed reaction kettle, leaching the deep reduction product with hydrochloric acid as a leaching solution at the temperature of 20° C. for 30 min to obtain filtrate and filter residues, removing the filtrate, washing the filter residues in a dynamic washing mode and drying the washed filter residues at the temperature of 20° C. for 24 h under a vacuum condition to obtain low-oxygen tantalum powder, wherein the molar concentration of hydrochloric acid is 2 mol/L, and diluted hydrochloric acid and the deep reduction product are in cooperation in a manner that the adding amount of diluted hydrochloric acid is 20% in excess of hydrochloric acid required by a reaction theory; and The low-oxygen tantalum powder comprises the following ingredients in percentage by mass: 99.3% of Ta, 0.25% of O and the balance of inevitable impurities, and the particle size of the low-oxygen tungsten powder is 34 μm.

Embodiment 9

The method for preparing high-melting-point metal powder through multi-stage deep reduction provided by the invention comprises the following steps:

Step 1, Performing Self-Propagating Reaction:

Placing tantalum oxide powder in a drying oven, drying the tantalum oxide powder at the temperature of 100-150° C. for 24 h to obtain dried tantalum oxide powder, mixing the dried tantalum oxide powder with the magnesium powder according to a molar ratio of $Ta_2O_5$ to Mg being 1 to 2.8 to obtain mixed materials, pressing the mixed materials at 20 MPa to obtain a block blank, adding the block blank into the self-propagating reaction furnace, initiating the self-propagating reaction in a local ignition mode, controlling the temperature at 650° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 24° C. and the leaching time is 120 min to obtain a leaching solution and a leaching product, removing the leaching solution, washing the leaching product in a dynamic washing mode, and performing vacuum drying at 20° C. for 24 h to obtain an oxide $Ta_xO$ precursor of the low-valence high-melting-point metal, wherein the molar concentration of hydrochloric acid is 1 mol/L, the diluted hydrochloric acid and the intermediate product are in cooperation in a manner that the adding amount of diluted hydrochloric acid is 30% in excess of hydrochloric acid required by a reaction theory, and The oxide $Ta_xO$ precursor of the low-valence high-melting-point metal comprises the following ingredients by percentage by mass of 20% of O, smaller than or equal to 0.5% of the inevitable impurities and the balance of the high-melting-point metal, wherein the particle size is 0.8-15 μm;

Step 3, Performing Multi-Stage Deep Reduction:

Uniformly mixing the oxide $Ta_xO$ precursor of the low-valence high-melting-point metal with calcium powder, performing pressing at 5 MPa to obtain a block blank, placing the block blank in a vacuum reduction furnace, performing heating under the condition that the vacuum degree is smaller than or equal to 10 Pa to 1000° C., performing secondary deep reduction for 2 h, obtaining a block billet after secondary deep reduction, and cooling the block billet along with the furnace to obtain a deep reduction product, wherein the molar ratio is described as follows: $Ta_xO$:Ca=1:2.5; and Step 4, Performing Secondary Leaching:

Placing the deep reduction product in the closed reaction kettle, leaching the deep reduction product with hydrochloric acid as a leaching solution at the temperature of 20° C. for 30 min to obtain filtrate and filter residues, removing the filtrate, washing the filter residues in a dynamic washing mode and drying the washed filter residues at the temperature of 20° C. for 24 h under a vacuum condition to obtain low-oxygen tantalum powder, wherein the molar concentration of hydrochloric acid is 6 mol/L, and diluted hydrochloric acid and the deep reduction product are in cooperation in a manner that the adding amount of diluted hydrochloric acid is 5% in excess of hydrochloric acid required by a reaction theory; and The low-oxygen tantalum powder comprises the following ingredients in percentage by mass: 99.5% of Ta, 0.25% of O and the balance of inevitable impurities, and the particle size of the low-oxygen tungsten powder is 44 μm.

Embodiment 10

The method for preparing high-melting-point metal powder through multi-stage deep reduction provided by the invention comprises the following steps:

Step 1, Performing Self-Propagating Reaction:

Placing niobium oxide powder in a drying oven, drying the niobium oxide powder at the temperature of 100-150° C. for 24 h to obtain dried niobium oxide powder, mixing the dried niobium oxide powder with the magnesium powder according to a molar ratio of $Nb_2O_5$ to Mg being 1 to 3 to obtain mixed materials, pressing the mixed materials at 10 MPa to obtain a block blank, adding the block blank into the self-propagating reaction furnace, initiating the self-propagating reaction in a local ignition mode, controlling the temperature at 580° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 24° C. and the leaching time is 120 min to obtain a leaching solution and a leaching product, removing the leaching solution, washing the leaching product in a dynamic washing mode, and performing vacuum drying at 20° C. for 24 h to obtain an oxide $Nb_xO$ precursor of the low-valence high-melting-point metal, wherein the molar concentration of hydrochloric acid is 1 mol/L, the diluted hydrochloric acid and the intermediate product are in cooperation in a manner that the adding amount of diluted hydrochloric acid is 30% in excess of hydrochloric acid required by a reaction theory, and The oxide $Nb_xO$ precursor of the low-valence high-melting-point metal comprises the following ingredients by percentage by mass of 5% of O, smaller than or equal to 0.5% of the inevitable impurities and the balance of the high-melting-point metal, wherein the particle size is 0.8-15 μm;

Step 3, Performing Multi-Stage Deep Reduction:

Uniformly mixing the oxide $Nb_xO$ precursor of the low-valence high-melting-point metal with calcium powder, performing pressing at 5 MPa to obtain a block blank, placing the block blank in a vacuum reduction furnace, performing heating under the condition that the vacuum degree is smaller than or equal to 10 Pa to 1000° C., performing secondary deep reduction for 3 h, obtaining a block billet after secondary deep reduction, and cooling the block billet along with the furnace to obtain a deep reduction product, wherein the molar ratio is described as follows: $Nb_xO$:Ca=1:2.2; and Step 4, Performing Secondary Leaching:

Placing the deep reduction product in the closed reaction kettle, leaching the deep reduction product with hydrochloric acid as a leaching solution at the temperature of 20° C. for 30 min to obtain filtrate and filter residues, removing the filtrate, washing the filter residues in a dynamic washing mode and drying the washed filter residues at the temperature of 30° C. for 24 h under a vacuum condition to obtain low-oxygen niobium powder, wherein the molar concentration of hydrochloric acid is 1 mol/L, and diluted hydrochloric acid and the deep reduction product are in cooperation in a manner that the adding amount of diluted hydrochloric acid is 20% in excess of hydrochloric acid required by a reaction theory; and The low-oxygen niobium powder comprises the following ingredients in percentage by mass: 99.5% of Nb, 0.16% of O and the balance of inevitable impurities, and the particle size of the low-oxygen tungsten powder is 42 μm.

Embodiment 11

The method for preparing high-melting-point metal powder through multi-stage deep reduction provided by the invention comprises the following steps:

Step 1, Performing Self-Propagating Reaction:

Placing niobium oxide powder in a drying oven, drying the niobium oxide powder at the temperature of 100-150° C. for 24 h to obtain dried niobium oxide powder, mixing the dried niobium oxide powder with the magnesium powder according to a molar ratio of $Nb_2O_5$ to Mg being 1 to 2.8 to obtain mixed materials, pressing the mixed materials at 30 MPa to obtain a block blank, adding the block blank into the self-propagating reaction furnace, initiating the self-propagating reaction in a local ignition mode, controlling the temperature at 700° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 24° C. and the leaching time is 90 min to obtain a leaching solution and a leaching product, removing the leaching solution, washing the leaching product in a dynamic washing mode, and performing vacuum drying at 20° C. for 24 h to obtain an oxide $Nb_xO$ precursor of the low-valence high-melting-point metal, wherein the molar concentration of hydrochloric acid is 3 mol/L, the diluted hydrochloric acid and the intermediate product are in cooperation in a manner that the adding amount of diluted hydrochloric acid is 30% in excess of hydrochloric acid required by a reaction theory, and The oxide $Nb_xO$ precursor of the low-valence high-melting-point metal comprises the following ingredients by percentage by mass of 7% of O, smaller than or equal to 0.5% of the inevitable impurities and the balance of the high-melting-point metal, wherein the particle size is 0.8-15 μm;

Step 3, Performing Multi-Stage Deep Reduction:

Uniformly mixing the oxide $Nb_xO$ precursor of the low-valence high-melting-point metal with calcium powder, performing pressing at 5 MPa to obtain a block blank, placing the block blank in a vacuum reduction furnace, performing heating under the condition that the vacuum degree is smaller than or equal to 10 Pa to 900° C., performing secondary deep reduction for 3 h, obtaining a block billet after secondary deep reduction, and cooling the block billet along with the furnace to obtain a deep reduction product, wherein the molar ratio is described as follows: $Nb_xO$:Ca=1:2; and Step 4, Performing Secondary Leaching:

Placing the deep reduction product in the closed reaction kettle, leaching the deep reduction product with hydrochloric acid as a leaching solution at the temperature of 20° C. for 90 min to obtain filtrate and filter residues, removing the filtrate, washing the filter residues in a dynamic washing mode and drying the washed filter residues at the temperature of 25° C. for 24 h under a vacuum condition to obtain low-oxygen niobium powder, wherein the molar concentration of hydrochloric acid is 2 mol/L, and diluted hydrochloric acid and the deep reduction product are in cooperation in a manner that the adding amount of diluted hydrochloric acid is 20% in excess of hydrochloric acid required by a reaction theory; and The low-oxygen niobium powder comprises the following ingredients in percentage by mass: 99.2% of Nb, 0.41% of O and the balance of inevitable impurities, and the particle size of the low-oxygen tungsten powder is 46 μm.

Embodiment 12

The method for preparing high-melting-point metal powder through multi-stage deep reduction provided by the invention comprises the following steps:

Step 1, Performing Self-Propagating Reaction:

Placing niobium oxide powder in a drying oven, drying the niobium oxide powder at the temperature of 100-150° C. for 24 h to obtain dried niobium oxide powder, mixing the dried niobium oxide powder with the magnesium powder according to a molar ratio of $Nb_2O_5$ to Mg being 1 to 3.1 to obtain mixed materials, pressing the mixed materials at 50 MPa to obtain a block blank, adding the block blank into the self-propagating reaction furnace, initiating the self-propagating reaction in a local ignition mode, controlling the temperature at 700° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 24° C. and the leaching time is 80 min to obtain a leaching solution and a leaching product, removing the leaching solution, washing the leaching product in a dynamic washing mode, and performing vacuum drying at 20° C. for 24 h to obtain an oxide $Nb_xO$ precursor of the low-valence high-melting-point metal, wherein the molar concentration of hydrochloric acid is 4 mol/L, the diluted hydrochloric acid and the intermediate product are in cooperation in a manner that the adding amount of diluted hydrochloric acid is 30% in excess of hydrochloric acid required by a reaction theory, and The oxide $Nb_xO$ precursor of the low-valence high-melting-point metal comprises the following ingredients by percentage by mass of 18% of O, smaller than or equal to 0.5% of the inevitable impurities and the balance of the high-melting-point metal, wherein the particle size is 0.8-15 μm;

Step 3, Performing Multi-Stage Deep Reduction:

Uniformly mixing the oxide $Nb_xO$ precursor of the low-valence high-melting-point metal with calcium powder, performing pressing at 5 MPa to obtain a block blank, placing the block blank in a vacuum reduction furnace, performing heating under the condition that the vacuum degree is smaller than or equal to 10 Pa to 900° C., performing secondary deep reduction for 3 h, obtaining a block billet after secondary deep reduction, and cooling the block billet along with the furnace to obtain a deep reduction product, wherein the molar ratio is described as follows: $Nb_xO$:Ca=1:3; and Step 4, Performing Secondary Leaching:

Placing the deep reduction product in the closed reaction kettle, leaching the deep reduction product with hydrochloric acid as a leaching solution at the temperature of 30° C. for 15 min to obtain filtrate and filter residues, removing the filtrate, washing the filter residues in a dynamic washing mode and drying the washed filter residues at the temperature of 20° C. for 24 h under a vacuum condition to obtain low-oxygen niobium powder, wherein the molar concentration of hydrochloric acid is 3 mol/L, and diluted hydrochloric acid and the deep reduction product are in cooperation in a manner that the adding amount of diluted hydrochloric acid is 20% in excess of hydrochloric acid required by a reaction theory; and The low-oxygen niobium powder comprises the following ingredients in percentage by mass: 99.3% of Nb, 0.22% of O and the balance of inevitable impurities, and the particle size of the low-oxygen tungsten powder is 51 μm.

Embodiment 13

The method for preparing high-melting-point metal powder through multi-stage deep reduction provided by the invention comprises the following steps:

Step 1, Performing Self-Propagating Reaction:

Placing vanadium oxide powder in a drying oven, drying the vanadium oxide powder at the temperature of 100-150° C. for 24 h to obtain dried vanadium oxide powder, mixing the dried vanadium oxide powder with the magnesium powder according to a molar ratio of $V_2O_5$ to Mg being 1 to 3 to obtain mixed materials, pressing the mixed materials at 10 MPa to obtain a block blank, adding the block blank into the self-propagating reaction furnace, initiating the self-propagating reaction in a local ignition mode, controlling the temperature at 500° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 24° C. and the leaching time is 120 min to obtain a leaching solution and a leaching product, removing the leaching solution, washing the leaching product in a dynamic washing mode, and performing vacuum drying at 25° C. for 24 h to obtain an oxide $V_xO$ precursor of the low-valence high-melting-point metal, wherein the molar concentration of hydrochloric acid is 1 mol/L, the diluted hydrochloric acid and the intermediate product are in cooperation in a manner that the adding amount of diluted hydrochloric acid is 40% in excess of hydrochloric acid required by a reaction theory, and The oxide $V_xO$ precursor of the low-valence high-melting-point metal comprises the following ingredients by percentage by mass of 6% of O, smaller than or equal to 0.5% of the inevitable impurities and the balance of the high-melting-point metal, wherein the particle size is 0.8-15 μm;

Step 3, Performing Multi-Stage Deep Reduction:

Uniformly mixing the oxide $V_xO$ precursor of the low-valence high-melting-point metal with calcium powder, performing pressing at 5 MPa to obtain a block blank, placing the block blank in a vacuum reduction furnace, performing heating under the condition that the vacuum degree is smaller than or equal to 10 Pa to 1000° C., performing secondary deep reduction for 3 h, obtaining a block billet after secondary deep reduction, and cooling the block billet along with the furnace to obtain a deep reduction product, wherein the molar ratio is described as follows: $V_xO$:Ca=1:2.2; and Step 4, Performing Secondary Leaching:

Placing the deep reduction product in the closed reaction kettle, leaching the deep reduction product with hydrochloric acid as a leaching solution at the temperature of 30° C. for 30 min to obtain filtrate and filter residues, removing the filtrate, washing the filter residues in a dynamic washing mode and drying the washed filter residues at the temperature of 20° C. for 24 h under a vacuum condition to obtain low-oxygen vanadium powder, wherein the molar concentration of hydrochloric acid is 1 mol/L, and diluted hydrochloric acid and the deep reduction product are in cooperation in a manner that the adding amount of diluted hydrochloric acid is 30% in excess of hydrochloric acid required by a reaction theory; and The low-oxygen vanadium powder comprises the following ingredients in percentage by mass: 99.5% of V, 0.11% of O and the balance of inevitable impurities, and the particle size of the low-oxygen tungsten powder is 42 μm.

Embodiment 14

The method for preparing high-melting-point metal powder through multi-stage deep reduction provided by the invention comprises the following steps:

Step 1, Performing Self-Propagating Reaction:

Placing vanadium oxide powder in a drying oven, drying the vanadium oxide powder at the temperature of 100-150° C. for 24 h to obtain dried vanadium oxide powder, mixing the dried vanadium oxide powder with the magnesium powder according to a molar ratio of $V_2O_5$ to Mg being 1 to 2.7 to obtain mixed materials, pressing the mixed materials at 30 MPa to obtain a block blank, adding the block blank into the self-propagating reaction furnace, initiating the self-propagating reaction in a local ignition mode, controlling the temperature at 750° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 25° C. and the leaching time is 90 min to obtain a leaching solution and a leaching product, removing the leaching solution, washing the leaching product in a dynamic washing mode, and performing vacuum drying at 20° C. for 24 h to obtain an oxide $V_xO$ precursor of the low-valence high-melting-point metal, wherein the molar concentration of hydrochloric acid is 3 mol/L, the diluted hydrochloric acid and the intermediate product are in cooperation in a manner that the adding amount of diluted hydrochloric acid is 40% in excess of hydrochloric acid required by a reaction theory, and The oxide $V_xO$ precursor of the low-valence high-melting-point metal comprises the following ingredients by percentage by mass of 8% of O, smaller than or equal to 0.5% of the inevitable impurities and the balance of the high-melting-point metal, wherein the particle size is 0.8-15 μm;

Step 3, Performing Multi-Stage Deep Reduction:

Uniformly mixing the oxide $V_xO$ precursor of the low-valence high-melting-point metal with calcium powder, performing pressing at 5 MPa to obtain a block blank, placing the block blank in a vacuum reduction furnace, performing heating under the condition that the vacuum degree is smaller than or equal to 10 Pa to 900° C., performing secondary deep reduction for 3 h, obtaining a block billet after secondary deep reduction, and cooling the block billet along with the furnace to obtain a deep reduction product, wherein the molar ratio is described as follows: $V_xO$:Ca=1:2; and Step 4, Performing Secondary Leaching:

Placing the deep reduction product in the closed reaction kettle, leaching the deep reduction product with hydrochloric acid as a leaching solution at the temperature of 30° C. for 20 min to obtain filtrate and filter residues, removing the filtrate, washing the filter residues in a dynamic washing mode and drying the washed filter residues at the temperature of 25° C. for 24 h under a vacuum condition to obtain low-oxygen vanadium powder, wherein the molar concentration of hydrochloric acid is 2 mol/L, and diluted hydrochloric acid and the deep reduction product are in cooperation in a manner that the adding amount of diluted hydrochloric acid is 30% in excess of hydrochloric acid required by a reaction theory; and The low-oxygen vanadium powder comprises the following ingredients in percentage by mass: 99.2% of V, 0.41% of O and the balance of inevitable impurities, and the particle size of the low-oxygen tungsten powder is 46 km.

Embodiment 15

The method for preparing high-melting-point metal powder through multi-stage deep reduction provided by the invention comprises the following steps:

Step 1, Performing Self-Propagating Reaction:

Placing vanadium oxide powder in a drying oven, drying the vanadium oxide powder at the temperature of 100-150° C. for 24 h to obtain dried vanadium oxide powder, mixing the dried vanadium oxide powder with the magnesium powder according to a molar ratio of $V_2O_5$ to Mg being 1 to 2.8 to obtain mixed materials, pressing the mixed materials at 50 MPa to obtain a block blank, adding the block blank into the self-propagating reaction furnace, initiating the self-propagating reaction in a local ignition mode, controlling the temperature at 550° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 25° C. and the leaching time is 80 min to obtain a leaching solution and a leaching product, removing the leaching solution, washing the leaching product in a dynamic washing mode, and performing vacuum drying at 20° C. for 24 h to obtain an oxide $V_xO$ precursor of the low-valence high-melting-point metal, wherein the molar concentration of hydrochloric acid is 4 mol/L, the diluted hydrochloric acid and the intermediate product are in cooperation in a manner that the adding amount of diluted hydrochloric acid is 40% in excess of hydrochloric acid required by a reaction theory, and The oxide $V_xO$ precursor of the low-valence high-melting-point metal comprises the following ingredients by percentage by mass of 12% of O, smaller than or equal to 0.5% of the inevitable impurities and the balance of the high-melting-point metal, wherein the particle size is 0.8-15 μm;

Step 3, Performing Multi-Stage Deep Reduction:

Uniformly mixing the oxide $V_xO$ precursor of the low-valence high-melting-point metal with calcium powder, performing pressing at 5 MPa to obtain a block blank, placing the block blank in a vacuum reduction furnace, performing heating under the condition that the vacuum degree is smaller than or equal to 10 Pa to 900° C., performing secondary deep reduction for 3 h, obtaining a block billet after secondary deep reduction, and cooling the block billet along with the furnace to obtain a deep reduction product, wherein the molar ratio is described as follows: $V_xO$:Ca=1:3; and Step 4, Performing Secondary Leaching:

Placing the deep reduction product in the closed reaction kettle, leaching the deep reduction product with hydrochloric acid as a leaching solution at the temperature of 30° C. for 15 min to obtain filtrate and filter residues, removing the filtrate, washing the filter residues in a dynamic washing mode and drying the washed filter residues at the temperature of 25° C. for 24 h under a vacuum condition to obtain low-oxygen vanadium powder, wherein the molar concentration of hydrochloric acid is 3 mol/L, and diluted hydrochloric acid and the deep reduction product are in cooperation in a manner that the adding amount of diluted hydrochloric acid is 30% in excess of hydrochloric acid required by a reaction theory; and The low-oxygen vanadium powder comprises the following ingredients in percentage by mass: 99.2% of V, 0.22% of O and the balance of inevitable impurities, and the particle size of the low-oxygen tungsten powder is 51 μm.

Embodiment 16

The method for preparing high-melting-point metal powder through multi-stage deep reduction provided by the invention comprises the following steps:

Step 1, Performing Self-Propagating Reaction:

Placing hafnium oxide powder in a drying oven, drying the hafnium oxide powder at the temperature of 100-150° C. for 24 h to obtain dried hafnium oxide powder, mixing the dried hafnium oxide powder with the magnesium powder according to a molar ratio of $HfO_2$ to Mg being 1 to 1 to obtain mixed materials, pressing the mixed materials at 30 MPa to obtain a block blank, adding the block blank into the self-propagating reaction furnace, initiating the self-propagating reaction in a local ignition mode, controlling the temperature at 600° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 20° C. and the leaching time is 180 min to obtain a leaching solution and a leaching product, removing the leaching solution, washing the leaching product in a dynamic washing mode, and performing vacuum drying at 20° C. for 24 h to obtain an oxide $Hf_xO$ precursor of the low-valence high-melting-point metal, wherein the molar concentration of hydrochloric acid is 1 mol/L, the diluted hydrochloric acid and the intermediate product are in cooperation in a manner that the adding amount of diluted hydrochloric acid is 40% in excess of hydrochloric acid required by a reaction theory, and The oxide $Hf_xO$ precursor of the low-valence high-melting-point metal comprises the following ingredients by percentage by mass of 15% of O, smaller than or equal to 0.5% of the inevitable impurities and the balance of the high-melting-point metal, wherein the particle size is 0.8-15 μm;

Step 3, Performing Multi-Stage Deep Reduction:

Uniformly mixing the oxide $Hf_xO$ precursor of the low-valence high-melting-point metal with calcium powder, performing pressing at 10 MPa to obtain a block blank, placing the block blank in a vacuum reduction furnace, performing heating under the condition that the vacuum degree is smaller than or equal to 10 Pa to 1000° C., performing secondary deep reduction for 2 h, obtaining a block billet after secondary deep reduction, and cooling the block billet along with the furnace to obtain a deep reduction product, wherein the molar ratio is described as follows: $Hf_JO$:Ca=1:1.6; and Step 4, Performing Secondary Leaching:

Placing the deep reduction product in the closed reaction kettle, leaching the deep reduction product with hydrochloric acid as a leaching solution at the temperature of 30° C. for 30 min to obtain filtrate and filter residues, removing the filtrate, washing the filter residues in a dynamic washing mode and drying the washed filter residues at the temperature of 25° C. for 24 h under a vacuum condition to obtain low-oxygen hafnium powder, wherein the molar concentration of hydrochloric acid is 1 mol/L, and diluted hydrochloric acid and the deep reduction product are in cooperation in a manner that the adding amount of diluted hydrochloric acid is 30% in excess of hydrochloric acid required by a reaction theory; and The low-oxygen hafnium powder comprises the following ingredients in percentage by mass: 99.4% of Hf, 0.12% of O and the balance of inevitable impurities, and the particle size of the low-oxygen tungsten powder is 5 μm.

Embodiment 17

The method for preparing high-melting-point metal powder through multi-stage deep reduction provided by the invention comprises the following steps:

Step 1, Performing Self-Propagating Reaction:

Placing hafnium oxide powder in a drying oven, drying the hafnium oxide powder at the temperature of 100-150° C. for 24 h to obtain dried hafnium oxide powder, mixing the dried hafnium oxide powder with the magnesium powder according to a molar ratio of $HfO_2$ to Mg being 1 to 1.2 to obtain mixed materials, pressing the mixed materials at 10 MPa to obtain a block blank, adding the block blank into the self-propagating reaction furnace, initiating the self-propagating reaction in a local ignition mode, controlling the temperature at 600° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 20° C. and the leaching time is 120 min to obtain a leaching solution and a leaching product, removing the leaching solution, washing the leaching product in a dynamic washing mode, and performing vacuum drying at 24° C. for 24 h to obtain an oxide $Hf_xO$ precursor of the low-valence high-melting-point metal, wherein the molar concentration of hydrochloric acid is 2 mol/L, the diluted hydrochloric acid and the intermediate product are in cooperation in a manner that the adding amount of diluted hydrochloric acid is 40% in excess of hydrochloric acid required by a reaction theory, and The oxide $Hf_xO$ precursor of the low-valence high-melting-point metal comprises the following ingredients by percentage by mass of 15% of O, smaller than or equal to 0.5% of the inevitable impurities and the balance of the high-melting-point metal, wherein the particle size is 0.8-15 μm;

Step 3, Performing Multi-Stage Deep Reduction:

Uniformly mixing the oxide $Hf_xO$ precursor of the low-valence high-melting-point metal with calcium powder, performing pressing at 15 MPa to obtain a block blank, placing the block blank in a vacuum reduction furnace, performing heating under the condition that the vacuum degree is smaller than or equal to 10 Pa to 900° C., performing secondary deep reduction for 3 h, obtaining a block billet after secondary deep reduction, and cooling the block billet along with the furnace to obtain a deep reduction product, wherein the molar ratio is described as follows: $Hf_xO$:Ca=1:2; and Step 4, Performing Secondary Leaching:

Placing the deep reduction product in the closed reaction kettle, leaching the deep reduction product with hydrochloric acid as a leaching solution at the temperature of 30° C. for 20 min to obtain filtrate and filter residues, removing the filtrate, washing the filter residues in a dynamic washing mode and drying the washed filter residues at the temperature of 30° C. for 24 h under a vacuum condition to obtain low-oxygen hafnium powder, wherein the molar concentration of hydrochloric acid is 2 mol/L, and diluted hydrochloric acid and the deep reduction product are in cooperation in a manner that the adding amount of diluted hydrochloric acid is 20% in excess of hydrochloric acid required by a reaction theory; and The low-oxygen hafnium powder comprises the following ingredients in percentage by mass: 99.2% of Hf, 0.27% of O and the balance of inevitable impurities, and the particle size of the low-oxygen tungsten powder is 40 μm.

Embodiment 18

The method for preparing high-melting-point metal powder through multi-stage deep reduction provided by the invention comprises the following steps:

Step 1, Performing Self-Propagating Reaction:

Placing hafnium oxide powder in a drying oven, drying the hafnium oxide powder at the temperature of 100-150° C. for 24 h to obtain dried hafnium oxide powder, mixing the dried hafnium oxide powder with the magnesium powder according to a molar ratio of $HfO_2$ to Mg being 1 to 0.9 to obtain mixed materials, pressing the mixed materials at 50 MPa to obtain a block blank, adding the block blank into the self-propagating reaction furnace, initiating the self-propagating reaction in a local ignition mode, controlling the temperature at 650° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 30° C. and the leaching time is 60 min to obtain a leaching solution and a leaching product, removing the leaching solution, washing the leaching product in a dynamic washing mode, and performing vacuum drying at 20° C. for 24 h to obtain an oxide $Hf_xO$ precursor of the low-valence high-melting-point metal, wherein the molar concentration of hydrochloric acid is 6 mol/L, the diluted hydrochloric acid and the intermediate product are in cooperation in a manner that the adding amount of diluted hydrochloric acid is 10% in excess of hydrochloric acid required by a reaction theory, and The oxide $Hf_xO$ precursor of the low-valence high-melting-point metal comprises the following ingredients by percentage by mass of 18% of O, smaller than or equal to 0.5% of the inevitable impurities and the balance of the high-melting-point metal, wherein the particle size is 0.8-15 μm;

Step 3, Performing Multi-Stage Deep Reduction:

Uniformly mixing the oxide $Hf_xO$ precursor of the low-valence high-melting-point metal with calcium powder, performing pressing at 5 MPa to obtain a block blank, placing the block blank in a vacuum reduction furnace, performing heating under the condition that the vacuum degree is smaller than or equal to 10 Pa to 1200° C., performing secondary deep reduction for 1 h, obtaining a block billet after secondary deep reduction, and cooling the block billet along with the furnace to obtain a deep reduction product, wherein the molar ratio is described as follows: $Hf_xO$:Ca=1:1.8; and Step 4, Performing Secondary Leaching:

Placing the deep reduction product in the closed reaction kettle, leaching the deep reduction product with hydrochloric acid as a leaching solution at the temperature of 30° C. for 15 min to obtain filtrate and filter residues, removing the filtrate, washing the filter residues in a dynamic washing mode and drying the washed filter residues at the temperature of 24 DEG C. for 24 h under a vacuum condition to obtain low-oxygen hafnium powder, wherein the molar concentration of hydrochloric acid is 3 mol/L, and diluted hydrochloric acid and the deep reduction product are in cooperation in a manner that the adding amount of diluted hydrochloric acid is 20% in excess of hydrochloric acid required by a reaction theory; and The low-oxygen hafnium powder comprises the following ingredients in percentage by mass: 99.4% of Hf, 0.21% of O and the balance of inevitable impurities, and the particle size of the low-oxygen tungsten powder is 60 μm.

Embodiment 19

The method for preparing high-melting-point metal powder through multi-stage deep reduction provided by the invention comprises the following steps:

Step 1, Performing Self-Propagating Reaction:

Placing zirconium oxide powder in a drying oven, drying the zirconium oxide powder at the temperature of 100-150° C. for 24 h to obtain dried zirconium oxide powder, mixing the dried zirconium oxide powder with the magnesium powder according to a molar ratio of $ZrO_2$ to Mg being 1 to 1 to obtain mixed materials, pressing the mixed materials at 30 MPa to obtain a block blank, adding the block blank into the self-propagating reaction furnace, initiating the self-propagating reaction in a local ignition mode, controlling the temperature at 650° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 30° C. and the leaching time is 180 min to obtain a leaching solution and a leaching product, removing the leaching solution, washing the leaching product in a dynamic washing mode, and performing vacuum drying at 22° C. for 24 h to obtain an oxide $Zr_xO$ precursor of the low-valence high-melting-point metal, wherein the molar concentration of hydrochloric acid is 1 mol/L, the diluted hydrochloric acid and the intermediate product are in cooperation in a manner that the adding amount of diluted hydrochloric acid is 40% in excess of hydrochloric acid required by a reaction theory, and The oxide $Zr_xO$ precursor of the low-valence high-melting-point metal comprises the following ingredients by percentage by mass of 12% of O, smaller than or equal to 0.5% of the inevitable impurities and the balance of the high-melting-point metal, wherein the particle size is 0.8-15 μm;

Step 3, Performing Multi-Stage Deep Reduction:

Uniformly mixing the oxide $Zr_xO$ precursor of the low-valence high-melting-point metal with calcium powder, performing pressing at 10 MPa to obtain a block blank, placing the block blank in a vacuum reduction furnace, performing heating under the condition that the vacuum degree is smaller than or equal to 10 Pa to 1000° C., performing secondary deep reduction for 2 h, obtaining a block billet after secondary deep reduction, and cooling the block billet along with the furnace to obtain a deep reduction product, wherein the molar ratio is described as follows: $Zr_xO$:Ca=1:1.5; and Step 4, Performing Secondary Leaching:

Placing the deep reduction product in the closed reaction kettle, leaching the deep reduction product with hydrochloric acid as a leaching solution at the temperature of 30° C. for 30 min to obtain filtrate and filter residues, removing the filtrate, washing the filter residues in a dynamic washing mode and drying the washed filter residues at the temperature of 24° C. for 24 h under a vacuum condition to obtain low-oxygen zirconium powder, wherein the molar concentration of hydrochloric acid is 1 mol/L, and diluted hydrochloric acid and the deep reduction product are in cooperation in a manner that the adding amount of diluted hydrochloric acid is 30% in excess of hydrochloric acid required by a reaction theory; and The low-oxygen zirconium powder comprises the following ingredients in percentage by mass: 99.5% of Zr, 0.12% of O and the balance of inevitable impurities, and the particle size of the low-oxygen tungsten powder is 36 μm.

Embodiment 20

The method for preparing high-melting-point metal powder through multi-stage deep reduction provided by the invention comprises the following steps:

Step 1, Performing Self-Propagating Reaction:

Placing zirconium oxide powder in a drying oven, drying the zirconium oxide powder at the temperature of 100-150° C. for 24 h to obtain dried zirconium oxide powder, mixing the dried zirconium oxide powder with the magnesium powder according to a molar ratio of $ZrO_2$ to Mg being 1 to 1.2 to obtain mixed materials, directly adding the mixed materials to the self-propagating reaction furnace, initiating the self-propagating reaction in a entire heating mode, controlling the temperature at 550° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 30° C. and the leaching time is 120 min to obtain a leaching solution and a leaching product, removing the leaching solution, washing the leaching product in a dynamic washing mode, and performing vacuum drying at 20° C. for 24 h to obtain an oxide $Zr_xO$ precursor of the low-valence high-melting-point metal, wherein the molar concentration of hydrochloric acid is 2 mol/L, the diluted hydrochloric acid and the intermediate product are in cooperation in a manner that the adding amount of diluted hydrochloric acid is 26% in excess of hydrochloric acid required by a reaction theory, and The oxide $Zr_xO$ precursor of the low-valence high-melting-point metal comprises the following ingredients by percentage by mass of 5-20% of O, smaller than or equal to 0.5% of the inevitable impurities and the balance of the high-melting-point metal, wherein the particle size is 0.8-15 μm;

Step 3, Performing Multi-Stage Deep Reduction:

Uniformly mixing the oxide $Zr_xO$ precursor of the low-valence high-melting-point metal with calcium powder, performing pressing at 20 MPa to obtain a block blank, placing the block blank in a vacuum reduction furnace, performing heating under the condition that the vacuum degree is smaller than or equal to 10 Pa to 900° C., performing secondary deep reduction for 3 h, obtaining a block billet after secondary deep reduction, and cooling the block billet along with the furnace to obtain a deep reduction product, wherein the molar ratio is described as follows: $Zr_xO$:Ca=1:2; and Step 4, Performing Secondary Leaching:

Placing the deep reduction product in the closed reaction kettle, leaching the deep reduction product with hydrochloric acid as a leaching solution at the temperature of 30° C. for 20 min to obtain filtrate and filter residues, removing the filtrate, washing the filter residues in a dynamic washing mode and drying the washed filter residues at the temperature of 22° C. for 24 h under a vacuum condition to obtain low-oxygen zirconium powder, wherein the molar concentration of hydrochloric acid is 2 mol/L, and diluted hydrochloric acid and the deep reduction product are in cooperation in a manner that the adding amount of diluted hydrochloric acid is 15% in excess of hydrochloric acid required by a reaction theory; and The low-oxygen zirconium powder comprises the following ingredients in percentage by mass: 99.1% of Zr, 0.35% of O and the balance of inevitable impurities, and the particle size of the low-oxygen tungsten powder is 40 μm.

Embodiment 21

The method for preparing high-melting-point metal powder through multi-stage deep reduction provided by the invention comprises the following steps:

Step 1, Performing Self-Propagating Reaction:

Placing zirconium oxide powder in a drying oven, drying the zirconium oxide powder at the temperature of 100-150° C. for 24 h to obtain dried zirconium oxide powder, mixing the dried zirconium oxide powder with the magnesium powder according to a molar ratio of $ZrO_2$ to Mg being 1 to 0.8 to obtain mixed materials, pressing the mixed materials at 50 MPa to obtain a block blank, adding the block blank into the self-propagating reaction furnace, initiating the self-propagating reaction in a local ignition mode, controlling the temperature at 570° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 30° C. and the leaching time is 60 min to obtain a leaching solution and a leaching product, removing the leaching solution, washing the leaching product in a dynamic washing mode, and performing vacuum drying at 30° C. for 24 h to obtain an oxide $Zr_xO$ precursor of the low-valence high-melting-point metal, wherein the molar concentration of hydrochloric acid is 6 mol/L, the diluted hydrochloric acid and the intermediate product are in cooperation in a manner that the adding amount of diluted hydrochloric acid is 12% in excess of hydrochloric acid required by a reaction theory, and The oxide $Zr_xO$ precursor of the low-valence high-melting-point metal comprises the following ingredients by percentage by mass of 15% of O, smaller than or equal to 0.5% of the inevitable impurities and the balance of the high-melting-point metal, wherein the particle size is 0.8-15 μm;

Step 3, Performing Multi-Stage Deep Reduction:

Uniformly mixing the oxide $Zr_xO$ precursor of the low-valence high-melting-point metal with calcium powder, performing pressing at 5 MPa to obtain a block blank, placing the block blank in a vacuum reduction furnace, performing heating under the condition that the vacuum degree is smaller than or equal to 10 Pa to 1100° C., performing secondary deep reduction for 2 h, obtaining a block billet after secondary deep reduction, and cooling the block billet along with the furnace to obtain a deep reduction product, wherein the molar ratio is described as follows: $Zr_xO$:Ca=1:1.8; and Step 4, Performing Secondary Leaching:

Placing the deep reduction product in the closed reaction kettle, leaching the deep reduction product with hydrochloric acid as a leaching solution at the temperature of 30° C.

for 15 min to obtain filtrate and filter residues, removing the filtrate, washing the filter residues in a dynamic washing mode and drying the washed filter residues at the temperature of 24° C. for 24 h under a vacuum condition to obtain low-oxygen zirconium powder, wherein the molar concentration of hydrochloric acid is 3 mol/L, and diluted hydrochloric acid and the deep reduction product are in cooperation in a manner that the adding amount of diluted hydrochloric acid is 25% in excess of hydrochloric acid required by a reaction theory; and The low-oxygen zirconium powder comprises the following ingredients in percentage by mass: 99.3% of Zr, 0.21% of O and the balance of inevitable impurities, and the particle size of the low-oxygen tungsten powder is 47 μm.

Embodiment 22

The method for preparing high-melting-point metal powder through multi-stage deep reduction provided by the invention comprises the following steps:

Step 1, Performing Self-Propagating Reaction:

Placing rhenium oxide powder in a drying oven, drying the rhenium oxide powder at the temperature of 100-150° C. for 24 h to obtain dried rhenium oxide powder, mixing the dried rhenium oxide powder with the magnesium powder according to a molar ratio of $Re_2O_7$ to Mg being 1 to 3 to obtain mixed materials, pressing the mixed materials at 40 MPa to obtain a block blank, adding the block blank into the self-propagating reaction furnace, initiating the self-propagating reaction in a local ignition mode, controlling the temperature at 650° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 30° C. and the leaching time is 180 min to obtain a leaching solution and a leaching product, removing the leaching solution, washing the leaching product in a dynamic washing mode, and performing vacuum drying at 20° C. for 24 h to obtain an oxide $Re_xO$ precursor of the low-valence high-melting-point metal, wherein the molar concentration of hydrochloric acid is 1 mol/L, the diluted hydrochloric acid and the intermediate product are in cooperation in a manner that the adding amount of diluted hydrochloric acid is 12% in excess of hydrochloric acid required by a reaction theory, and The oxide $Re_xO$ precursor of the low-valence high-melting-point metal comprises the following ingredients by percentage by mass of 5% of O, smaller than or equal to 0.5% of the inevitable impurities and the balance of the high-melting-point metal, wherein the particle size is 0.8-15 μm;

Step 3, Performing Multi-Stage Deep Reduction:

Uniformly mixing the oxide $Re_xO$ precursor of the low-valence high-melting-point metal with calcium powder, performing pressing at 10 MPa to obtain a block blank, placing the block blank in a vacuum reduction furnace, performing heating under the condition that the vacuum degree is smaller than or equal to 10 Pa to 700° C., performing secondary deep reduction for 6 h, obtaining a block billet after secondary deep reduction, and cooling the block billet along with the furnace to obtain a deep reduction product, wherein the molar ratio is described as follows: $Re_xO$:Ca=1:1.5; and Step 4, Performing Secondary Leaching:

Placing the deep reduction product in the closed reaction kettle, leaching the deep reduction product with hydrochloric acid as a leaching solution at the temperature of 30° C. for 30 min to obtain filtrate and filter residues, removing the filtrate, washing the filter residues in a dynamic washing mode and drying the washed filter residues at the temperature of 20° C. for 24 h under a vacuum condition to obtain low-oxygen rhenium powder, wherein the molar concentration of hydrochloric acid is 2 mol/L, and diluted hydrochloric acid and the deep reduction product are in cooperation in a manner that the adding amount of diluted hydrochloric acid is 15% in excess of hydrochloric acid required by a reaction theory; and The low-oxygen rhenium powder comprises the following ingredients in percentage by mass: 99.5% of Re, 0.12% of O and the balance of inevitable impurities, and the particle size of the low-oxygen tungsten powder is 37 μm.

Embodiment 23

The method for preparing high-melting-point metal powder through multi-stage deep reduction provided by the invention comprises the following steps:

Step 1, Performing Self-Propagating Reaction:

Placing rhenium oxide powder in a drying oven, drying the rhenium oxide powder at the temperature of 100-150° C. for 24 h to obtain dried rhenium oxide powder, mixing the dried rhenium oxide powder with the magnesium powder according to a molar ratio of $Re_2O_7$ to Mg being 1 to 2.9 to obtain mixed materials, pressing the mixed materials at 30 MPa to obtain a block blank, adding the block blank into the self-propagating reaction furnace, initiating the self-propagating reaction in a local ignition mode, controlling the temperature at 650° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 30° C. and the leaching time is 100 min to obtain a leaching solution and a leaching product, removing the leaching solution, washing the leaching product in a dynamic washing mode, and performing vacuum drying at 30° C. for 24 h to obtain an oxide $Re_xO$ precursor of the low-valence high-melting-point metal, wherein the molar concentration of hydrochloric acid is 4 mol/L, the diluted hydrochloric acid and the intermediate product are in cooperation in a manner that the adding amount of diluted hydrochloric acid is 30% in excess of hydrochloric acid required by a reaction theory, and The oxide $Re_xO$ precursor of the low-valence high-melting-point metal comprises the following ingredients by percentage by mass of 12% of O, smaller than or equal to 0.5% of the inevitable impurities and the balance of the high-melting-point metal, wherein the particle size is 0.8-15 μm;

Step 3, Performing Multi-Stage Deep Reduction:

Uniformly mixing the oxide $Re_xO$ precursor of the low-valence high-melting-point metal with calcium powder, performing pressing at 2 MPa to obtain a block blank, placing the block blank in a vacuum reduction furnace, performing heating under the condition that the vacuum degree is smaller than or equal to 10 Pa to 900° C., performing secondary deep reduction for 4 h, obtaining a block billet after secondary deep reduction, and cooling the block billet along with the furnace to obtain a deep reduction product, wherein the molar ratio is described as follows: $Re_xO$:Ca=1:2; and Step 4, Performing Secondary Leaching:

Placing the deep reduction product in the closed reaction kettle, leaching the deep reduction product with hydrochloric acid as a leaching solution at the temperature of 30° C. for 30 min to obtain filtrate and filter residues, removing the filtrate, washing the filter residues in a dynamic washing mode and drying the washed filter residues at the temperature of 26° C. for 24 h under a vacuum condition to obtain low-oxygen rhenium powder, wherein the molar concentration of hydrochloric acid is 2 mol/L, and diluted hydrochloric acid and the deep reduction product are in cooperation in a manner that the adding amount of diluted hydrochloric acid is 25% in excess of hydrochloric acid required by a reaction theory; and The low-oxygen hafnium powder comprises the following ingredients in percentage by mass: 99.2% of Re, 0.25% of O and the balance of inevitable impurities, and the particle size of the low-oxygen tungsten powder is 45 μm.

Embodiment 24

The method for preparing high-melting-point metal powder through multi-stage deep reduction provided by the invention comprises the following steps:

Step 1, Performing Self-Propagating Reaction:

Placing rhenium oxide powder in a drying oven, drying the rhenium oxide powder at the temperature of 100-150° C. for 24 h to obtain dried rhenium oxide powder, mixing the dried rhenium oxide powder with the magnesium powder according to a molar ratio of $Re_2O_7$ to Mg being 1 to 3.3 to obtain mixed materials, pressing the mixed materials at 40 MPa to obtain a block blank, adding the block blank into the self-propagating reaction furnace, initiating the self-propagating reaction in a local ignition mode, controlling the temperature at 650° C. and performing cooling to obtain an intermediate product in which a low-valence oxide $Me_xO$ of high-melting-point metal is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, and x is 0.2-1;

Step 2, Performing Primary Leaching:

Placing the intermediate product in which the low-valence oxide $Me_xO$ of the high-melting-point metal is dispersed in the MgO matrix into a closed reaction kettle, leaching the intermediate product with hydrochloric acid as a leaching solution under the condition that the leaching temperature is 30° C. and the leaching time is 80 min to obtain a leaching solution and a leaching product, removing the leaching solution, washing the leaching product in a dynamic washing mode, and performing vacuum drying at 30° C. for 24 h to obtain an oxide $Re_xO$ precursor of the low-valence high-melting-point metal, wherein the molar concentration of hydrochloric acid is 6 mol/L, the diluted hydrochloric acid and the intermediate product are in cooperation in a manner that the adding amount of diluted hydrochloric acid is 12% in excess of hydrochloric acid required by a reaction theory, and The oxide $Re_xO$ precursor of the low-valence high-melting-point metal comprises the following ingredients by percentage by mass of 20% of O, smaller than or equal to 0.5% of the inevitable impurities and the balance of the high-melting-point metal, wherein the particle size is 0.8-15 μm;

Step 3, Performing Multi-Stage Deep Reduction:

Uniformly mixing the oxide $Re_xO$ precursor of the low-valence high-melting-point metal with calcium powder, performing pressing at 15 MPa to obtain a block blank, placing the block blank in a vacuum reduction furnace, performing heating under the condition that the vacuum degree is smaller than or equal to 10 Pa to 1100° C., performing secondary deep reduction for 2 h, obtaining a block billet after secondary deep reduction, and cooling the block billet along with the furnace to obtain a deep reduction product, wherein the molar ratio is described as follows: $Re_xO$:Ca=1:2; and Step 4, Performing Secondary Leaching:

Placing the deep reduction product in the closed reaction kettle, leaching the deep reduction product with hydrochloric acid as a leaching solution at the temperature of 30° C. for 30 min to obtain filtrate and filter residues, removing the filtrate, washing the filter residues in a dynamic washing mode and drying the washed filter residues at the temperature of 26° C. for 24 h under a vacuum condition to obtain low-oxygen rhenium powder, wherein the molar concentration of hydrochloric acid is 3 mol/L, and diluted hydrochloric acid and the deep reduction product are in cooperation in a manner that the adding amount of diluted hydrochloric acid is 25% in excess of hydrochloric acid required by a reaction theory; and The low-oxygen hafnium powder comprises the following ingredients in percentage by mass: 99.3% of Re, 0.21% of O and the balance of inevitable impurities, and the particle size of the low-oxygen tungsten powder is 47 μm.

What is claimed is:

1. A method for preparing a high-melting-point metal powder through a multi-stage deep reduction, comprising the following steps:

step 1, performing a self-propagating reaction:

drying a high-melting-point metal oxide powder to obtain a dried high-melting-point metal oxide powder, mixing the dried high-melting-point metal oxide powder with magnesium (Mg) powder to obtain mixed materials, adding the mixed materials into a self-propagating reaction furnace to perform the self-propagating reaction, and performing cooling to obtain an intermediate product in which a low-valence oxide $Me_xO$ of a high-melting-point metal (Me) is dispersed in an MgO matrix, wherein the intermediate product in which the low-valence oxide $Me_xO$ of the high-melting-point metal is dispersed in the MgO matrix is a mixture of low-valence high-melting-point metal oxides with a non-stoichiometric ratio, x is 0.2-1, the high-melting-point metal specifically comprises one or more of W, Mo, Ta, Nb, V, Zr, Hf and Re, the high-melting-point metal oxide is one or a mixture of several kinds of $WO_3$, $MoO_3$, $Ta_2O_5$, $Nb_2O_5$, $V_2O_5$, $ZrO_2$, $HfO_2$ and $Re_2O_7$, and when the high-melting-point metal oxide is $WO_3$, a mixing proportion in molar ratio of $WO_3$ to Mg is 1 to (0.8-1.2), when the high-melting-point metal oxide is $MoO_3$, a mixing proportion in molar ratio of $MoO_3$ to Mg is 1 to (0.8-1.2), when the high-melting-point metal oxide is $Ta_2O_5$, a mixing proportion in molar ratio of $Ta_2O_5$ to Mg is 1 to (2.7-3.3), when the high-melting-point metal oxide is $Nb_2O_5$, a mixing proportion in molar ratio of $Nb_2O_5$ to Mg is 1 to (2.7-3.3), when the high-melting-point metal oxide is $V_2O_5$, a mixing proportion in molar ratio of $V_2O_5$ to Mg is 1 to (2.7-3.3), when the high-melting-point metal oxide is $ZrO_2$, a mixing proportion in molar ratio of $ZrO_2$ to Mg is 1 to (0.8-1.2), when the high-melting-point metal oxide is $HfO_2$, a mixing proportion in molar ratio of $HfO_2$ to Mg is 1 to (0.8-1.2), and when the high-melting-point metal oxide is $Re_2O_7$, a mixing proportion in molar ratio of $Re_2O_7$ to Mg is 1 to (2.7-3.3);

step 2, performing a primary leaching:

placing the intermediate product in which the low-valence oxide $Me_xO$ of the high-melting-point metal is dispersed in the MgO matrix into a closed reaction kettle, leaching the intermediate product with hydrochloric acid as a leaching solution to obtain a leaching solution and a leaching product, removing the leaching solution, washing the leaching product, and performing vacuum drying on the washed leaching product to obtain a low-valence oxide $Me_xO$ precursor of the low-valence high-melting-point metal, wherein a molar concentration of hydrochloric acid is 1-6 mol/L;

step 3, performing the multi-stage deep reduction:

uniformly mixing the low-valence oxide $Me_xO$ precursor of the low-valence high-melting-point metal with calcium (Ca) powder, performing pressing at 2-20 MPa to obtain a block blank, placing the block blank in a vacuum reduction furnace, performing heating to 700-1,200° C., performing a secondary deep reduction for 1-6 h, obtaining a block billet after the secondary deep reduction, and cooling the block billet along with the vacuum reduction furnace to obtain a deep reduction product, wherein a molar ratio is described as follows: $Me_xO$:Ca=1:(1.5-3); and step 4, performing a secondary leaching:

placing the deep reduction product in the closed reaction kettle, leaching the deep reduction product with hydrochloric acid as a leaching solution to obtain a filtrate and filter residues, removing the filtrate, washing the filter residues and performing vacuum drying to obtain a low-oxygen high-melting-point metal powder, wherein a molar concentration of hydrochloric acid is 1-6 mol/L, the low-oxygen high-melting-point metal powder comprises the following ingredients by percentage by mass of equal to or smaller than 0.8% of O, greater than or equal to 99% of the high-melting-point metal and a balance of inevitable impurities, and a particle size of the low-oxygen high-melting-point metal powder is 5-60 μm.

2. The method according to claim 1, wherein in the step 1, the drying is performed in a specific operation step of placing the high-melting-point metal oxide powder into a drying oven, and performing the drying at a temperature of 100-150° C. for 24 h or above.

3. The method according to claim 1, wherein in the step 1, the mixed materials are treated in one of the following two ways before being added into the self-propagating reaction furnace:

a first treatment way comprises the following steps: pressing the mixed materials under 10-60 MPa to obtain a block blank, adding the block blank into the self-propagating reaction furnace and performing the self-propagating reaction; and a second treatment way comprises the following steps: directly adding the mixed materials into the self-propagating reaction furnace without treatment and performing the self-propagating reaction.

4. The method according to claim 1, wherein in the step 1, initiation modes of the self-propagating reaction are respectively a local ignition method and an overall heating method, wherein the local ignition method refers to heating a local part of the mixed materials by an electric heating wire in the self-propagating reaction furnace to initiate the self-propagating reaction; the overall heating method refers to raising a temperature of the whole mixed materials in the self-propagating reaction furnace until the self-propagating reaction occurs, and the temperature is controlled at 500-750° C.

5. The method according to claim 1, wherein in the step 2, when the intermediate product is leached, diluted hydrochloric acid and the intermediate product are in cooperation in a manner that an adding amount of the diluted hydrochloric acid is 10-40 volume % in excess of the hydrochloric acid required by a reaction theory; and in the step 2, a leaching temperature for leaching the intermediate product is 20-30° C., and a leaching time is 60-180 min.

6. The method according to claim 1, wherein in the step 2, the low-valence oxide $Me_xO$ precursor of the low-valence high-melting-point metal comprises the following ingredients by percentage by mass of 5-20% of O, smaller than or equal to 0.5% of the inevitable impurities and a balance of the high-melting-point metal, wherein a particle size is 0.8-15 μm.

7. The method according to claim 1, wherein in the step 2, the washing process and the vacuum drying process comprise the following specific steps: washing the leaching product without the leaching solution with water until a washing solution is neutral, and then drying the washed leaching product in a vacuum drying oven at a temperature of 20-30° C. for at least 24 h; and the washing is performed with water and specifically refers to dynamic washing, in which the washing solution in a washing tank is kept at a constant water level in the washing process, fresh water with the same amount of a drained washing liquid is supplemented, and the leaching product is washed until the washing liquid is neutral.

8. The method according to claim 1, wherein in the step 3, a reaction parameter for the secondary deep reduction lies in that heating is performed under the condition that the vacuum degree is less than or equal to 10 Pa.

9. The method according to claim 1, wherein in the step 4, when the deep reduction product is leached, diluted hydrochloric acid and the deep reduction product are in cooperation in a manner that an adding amount of the diluted hydrochloric acid is 5-30 volume % in excess of the hydrochloric acid required by a reaction theory; and in the step 4, a leaching temperature for leaching the deep reduction product is 20-30° C., and a leaching time is 15-90 min.

10. The method according to claim 1, wherein in the step 4, the washing process and the vacuum drying process comprise the following specific steps: washing the leaching product without the leaching solution with water until a washing solution is neutral, and then drying the washed leaching product in a vacuum drying oven at a temperature of 20-30° C. for at least 24 h; and the washing is performed with water and specifically refers to dynamic washing, in which the washing solution in a washing tank is kept at a constant water level in the washing process, fresh water with the same amount of a drained washing liquid is supplemented, and the leaching product is washed until the washing liquid is neutral.

* * * * *